US012402732B2

(12) United States Patent
Kaufman

(10) Patent No.: US 12,402,732 B2
(45) Date of Patent: Sep. 2, 2025

(54) SUPPORT PILLOW

(71) Applicant: Mud Valley LLC, Sugarcreek, OH (US)

(72) Inventor: Katelyn Kaufman, Sugarcreek, OH (US)

(73) Assignee: Mud Valley LLC, Sugarcreek, OH (US)

( * ) Notice: Subject to any disclaimer, the term of this patent is extended or adjusted under 35 U.S.C. 154(b) by 289 days.

(21) Appl. No.: 18/182,949

(22) Filed: Mar. 13, 2023

(65) Prior Publication Data

US 2023/0292940 A1 Sep. 21, 2023

Related U.S. Application Data

(60) Provisional application No. 63/321,811, filed on Mar. 21, 2022.

(51) Int. Cl.
*A47D 13/08* (2006.01)
*A47C 7/42* (2006.01)

(52) U.S. Cl.
CPC ..... *A47D 13/083* (2013.01); *A47C 7/425* (2013.01)

(58) Field of Classification Search
CPC .... A47D 15/006; A47D 13/08; A47D 13/083; A47C 20/028; A47C 20/027; A47C 20/025; A47C 7/42; A47C 7/425
USPC ..... 5/655
See application file for complete search history.

(56) References Cited

U.S. PATENT DOCUMENTS 3,840,916 A * 10/1974 Jennings ..... A47D 15/006 297/181
4,197,604 A * 4/1980 Nakamura ..... A47G 9/1045 446/72
5,519,906 A * 5/1996 Fanto-Chan ..... A47D 13/083 5/636

(Continued)

FOREIGN PATENT DOCUMENTS

CA 2505699 A1 * 10/2006 ..... A47C 20/021
CN 205285733 U * 6/2016

(Continued)

OTHER PUBLICATIONS

Boppy Nursing Pillow and Positioner, available on Amazon.com; date first available unknown; [site visited Feb. 6, 2023]; Available from the internet URL: https://www.amazon.com/Boppy-Original-Nursing-Positioner-Animals/dp/B08H6K7YKD/ref=sr_1_3_sspa?.

(Continued)

*Primary Examiner* — Eric J Kurilla
(74) *Attorney, Agent, or Firm* — Sand, Sebolt & Wernow Co., LPA

(57) ABSTRACT

A support pillow including a backrest, a first armrest, and a second armrest. The first and second armrests are detachably engageable with the backrest. Together, the backrest and first and second armrests define and encircle a space into which a person's torso is received when the person is seated and resting against the backrest. A free end of the first armrest is detachably engageable with a free end of the second armrest a distance spaced longitudinally forward of a front of the backrest. Each of the backrest, first armrest, and second armrest may be provided with a handle and may include one or more pockets.

15 Claims, 7 Drawing Sheets

(56) References Cited

U.S. PATENT DOCUMENTS

| | | | | | |
|---|---|---|---|---|---|
| 5,790,999 | A * | 8/1998 | Clark | A47D 13/083 5/655 |
| 7,356,861 | B1 * | 4/2008 | Pagano | A47D 1/00 5/655 |
| 7,587,773 | B2 * | 9/2009 | Littlehorn | A47C 20/025 5/655 |
| 8,590,078 | B1 * | 11/2013 | Zenoff | A47C 16/00 5/655 |
| 9,138,072 | B1 * | 9/2015 | Sanders | A47G 9/0253 |
| 2005/0235425 | A1 * | 10/2005 | Parrilla | A47D 13/08 5/655 |
| 2007/0056110 | A1 * | 3/2007 | Tuoriniemi | A47D 15/001 5/655 |
| 2011/0119833 | A1 * | 5/2011 | Clark | A47D 13/083 5/655 |
| 2013/0139320 | A1 * | 6/2013 | Tzameret | A47D 13/083 5/632 |
| 2020/0288877 | A1 * | 9/2020 | Duong | A47C 7/425 |

FOREIGN PATENT DOCUMENTS

| | | | | |
|---|---|---|---|---|
| CN | 209610669 | U | * | 11/2019 |
| CN | 210276708 | U | * | 4/2020 |
| CN | 213757527 | U | * | 7/2021 |
| JP | 2022091311 | A | * | 6/2022 |
| KR | 20130001557 | U | * | 3/2013 |
| KR | 20130004943 | U | * | 8/2013 |

OTHER PUBLICATIONS

ComfortSpa Reading Pillow Bed Wedge, available on Amazon.com; date first available unknown; [site visited Feb. 6, 2023]; Available from the internet URL: https://www.amazon.com/ComfortSpa-Reading-Backrest-Cushion-Heartburn/dp/B07GZB5SJZ/ref=sr_1_1_sspa?.

Husband Pillow XXL Dark Grey with Backrest and arms; available on Amazon.com; date first available unknown; [site visited Feb. 6, 2023]; Available from the internet URL: https://www.amazon.com/Husband-Pillow-Detachable-Removable-Adjustable/dp/B073WKJ67W/ref=sr_1_1_sspa?.

Lunix LX6 3pcs Orthopedic Bed Wedge Pillow Set; available on Amazon.com; date first available unknown; [site visited Feb. 6, 2023]; Available from the internet URL: https://www.amazon.com/Lunix-Orthopedic-Surgery-Adjustable-Sleeping/dp/B085W4NLZ4/ref=sr_1_6?.

Reading Pillow Large Bed Pillow; available on Amazon.com; date first available unknown; [site visited Feb. 6, 2023]; Available from the internet URL: https://www.amazon.com/Pillow-Extra-Detachable-Couch-Backrest-Watching-Relaxing/dp/B09BF9ZQFS/ref=sr_1_4?.

Vekkia Standard Lightweight Bed Reading Pillow; available on Amazon.com; date first available unknown; [site visited Feb. 6, 2023]; Available from the internet URL: https://www.amazon.com/Vekkia-Standard-Lightweight-Relaxing-Watching/dp/B0BKZV2RKG/ref=sr_1_5?.

My Brest Friend Original Pillow—Bluebells; available on Target.com; date first available Jun. 25, 2021 [site visited Feb. 6, 2023]; Available from the internet URL: https://www.target.com/p/my-brest-friend-original-pillow-bluebells/-/A-12717548.

https://www.amazon.com/Leachco-SnuggaHug-Contoured-Nursing-Pillow/dp/B07DKDMCXW- Published Jun. 6, 2018—Retrieved from the Internet on Nov. 15, 2023.

* cited by examiner

SUPPORT PILLOW

REFERENCE TO RELATED APPLICATIONS

This application claims the benefit of U.S. Provisional Patent Application Ser. No. 63/321,811, filed Mar. 21, 1622, the entire disclosure of which is incorporated herein by reference.

TECHNICAL FIELD

This disclosure is directed to seating aids. More particularly, the disclosure relates to a support pillow. Specifically, the disclosure is directed to a support pillow which provides comfortable back and arm support for a person when in a seated position and furthermore provides for support in front of the person's torso. The component parts of the support pillow are selectively detachably engageable with one another.

BACKGROUND ART

Support pillows are used to help support parts of a person's body when in a seated position so that the person can sit comfortably without placing undue strain on their body. Elderly persons, people recovering from surgery, or anyone else who may want to sit more comfortably and securely in an upright position can use a support pillow for such purposes.

One support pillow proposed by the prior art is the Vekkia™ Standard Lightweight Bed Reading Pillow available on Amazon.com. This support pillow includes a wedge-shaped backrest having a front surface sculpted to provide improved lumbar and hip support. Two rectangular pieces of foam extend outwardly from the backrest and are provided to support a person's arms. A pillowcase for the support pillow is configured to receive all three foam pads, i.e., the backrest and the two arms. The parts of the pillowcase for the two arm pads are permanently attached to the part of the pillowcase which receives the backrest. When the three foam pads are installed within the pillowcase, the armrests project outwardly and forwardly from the backrest and at about 90° relative to the backrest's front surface.

Another support pillow available on Amazon.com is the SLIGUY™ reading support pillow. Similar to the Vekkia™ support pillow referenced above, the Sliguy™ includes a backrest and two arms. The single pillowcase for the support pillow includes a region for the padded backrest and regions for the two arms. Instead of the armrests extending outwardly from the front surface of the backrest at about 90°, like the Vekkia™ pillow, in the Sliguy™ reading pillow the armrests flare outwardly away from one another moving in a direction away from the backrest's front surface. The pillow comes with a detachable neck roll which is secured to the part of the pillowcase which holds the backrest by button-type fasteners.

Other types of support pillow are nursing pillows or breastfeeding pillows. Nursing pillows help a caregiver support an infant at a comfortable height while breastfeeding the infant or while feeding them with a bottle. The nursing pillow bears most of the weight of the infant thereon and therefore takes some of the strain of holding the infant off the caregiver's back, shoulders, and arms.

A number of nursing pillows have been proposed in the prior art. For example, the BOPPY® Nursing Pillow and Positioner. (BOPPY® is a registered trademark of the Boppy Company, LLC. of Golden, Colorado, U.S.) The BOPPY® pillow is a C-shaped pillow that is placed on the caregiver's lap in such a way that the ends of the C-shape are adjacent the caregiver's waist and the body of the pillow rests on the caregiver's legs. The pillow is meant to help keep the baby at an appropriate and comfortable length for nursing. However, for taller caregivers, the pillow may not be sufficiently thick enough to support the baby at a comfortable nursing length. Additionally, the shape of the pillow is such that the weight of the baby tends to push the pillow away from the caregiver's body. The caregiver therefore has to constantly readjust the pillow's position in order to try and keep the baby close to the caregiver's body. In some embodiments, this tendency to push away from the body has been somewhat addressed by providing a strap that passes behind the caregiver's back and extends between the two ends of the C-shape of the pillow. The problem with the strap is that the caregiver has to use two hands to put the pillow into position around their body. The caregiver also needs two hands to remove the pillow. Caregivers sometimes only have one hand free and so it may be difficult if not impossible to engage or disengage the strap without putting the infant down. Another issue with this nursing pillow is that it has a rounded upper surface and this configuration tends to cause the infant to roll off the pillow away from the caregiver's body. It is therefore necessary that the caregiver pays careful attention to the location of the baby on the pillow so that they do not accidentally fall off the pillow.

SUMMARY OF THE INVENTION

A support pillow is disclosed herein which addresses some of the deficiencies of the prior art. The disclosed support pillow may be used in a variety of settings including but not limited to supporting elderly or infirm persons in a seated position, aiding those recovering from surgery, aiding caregivers while holding and/or feeding an infant, or simply to help a person sit more comfortably while reading or performing other tasks.

The support pillow in accordance with the present disclosure may be discussed herein particularly in use as a nursing pillow but it will be understood that the disclosed support pillow may be used in a wide variety of other applications.

In one aspect, an exemplary embodiment of the present disclosure may provide a support pillow comprising a backrest; a first armrest engageable with the backrest; a second armrest engageable with the backrest a lateral distance away from the first armrest; wherein each of the first armrest and the second armrest extends forwardly from the backrest and curves inwardly to terminate in a free end located a distance forwardly of a front of the backrest; wherein the free end of the first armrest is opposed to the free end of the second armrest; and wherein the backrest, the first armrest, and the second armrest, together, encircle a space adapted to receive a torso of a person therein.

In one embodiment, the support pillow may further comprise a securement mechanism which detachably secures the free end of the first armrest to the free end of the second armrest. In one embodiment, one or both of the first armrest and the second armrest may be detachably engageable with the backrest. In one embodiment, the support pillow may further comprise a first securement mechanism for detachably securing one of the first armrest and the second armrest to the backrest. In one embodiment, the support pillow may further comprise a second securement mechanism for detachably securing the other of the first armrest and the second armrest to the backrest. In one embodiment, the backrest may have a depth measured between the front and a rear thereof, and wherein the depth tapers moving in a direction from a bottom of the backrest to a top of the backrest. In one embodiment, the front of the backrest may be oriented at an angle of from about 75° up to about 85° relative to a bottom of the backrest. In one embodiment, a rear of the backrest may be oriented at 90° relative to a bottom of the backrest. In one embodiment, the support pillow may further comprise a handle provided on the backrest.

In one embodiment, the first armrest and the second armrest may be substantially identical to one another and may be arranged as mirror images of one another relative to the backrest. In one embodiment, each of the first armrest and the second armrest may have a top end, a bottom end, a front end, and a rear end; wherein each of the first armrest and the second armrest is of a height measured between the top end and the bottom end thereof; and wherein the height may taper moving in a direction from the rear end of the first armrest and the second armrest to the front end thereof. In one embodiment, the top end of each of the first armrest and the second armrest may be oriented at an angle of from about 75° up to about 85° relative to the rear end thereof. In one embodiment, the rear end of the first armrest and the second armrest may be oriented at 90° relative to the bottom end thereof. In one embodiment, the support pillow may further comprise a handle provided on one or both of the first armrest and the second armrest. In one embodiment, a rear end of each of the first armrest and the second armrest may be oriented at an angle of from about 190° up to about 210° relative to a back of the backrest. In one embodiment, each of the first armrest and the second armrest may be generally J-shaped. In one embodiment, each of the first armrest and the second armrest may be of a width proximate a rear end thereof, wherein the rear end is located proximate a back of the backrest, and wherein the width tapers moving from the rear end towards a front end thereof. In one embodiment, the support pillow may further comprise one or more pockets provided on one or more of the backrest, the first armrest, and the second armrest.

In one aspect, an exemplary embodiment of the present disclosure may provide a method comprising detachably engaging a first end of a first armrest with a backrest of a support pillow; detachably engaging a first end of a second armrest with the backrest a laterally-spaced distance from the first end of the first armrest; placing a second end of the first armrest in close proximity to a second end of the second armrest a distance longitudinally forwardly of a front of the backrest; and encircling a space with the backrest, the first armrest, and the second armrest; wherein the space is adapted to receive a torso of a person resting against the backrest. In one embodiment, the method may further comprise detachably engaging the second end of the first armrest to the second end of the second armrest.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
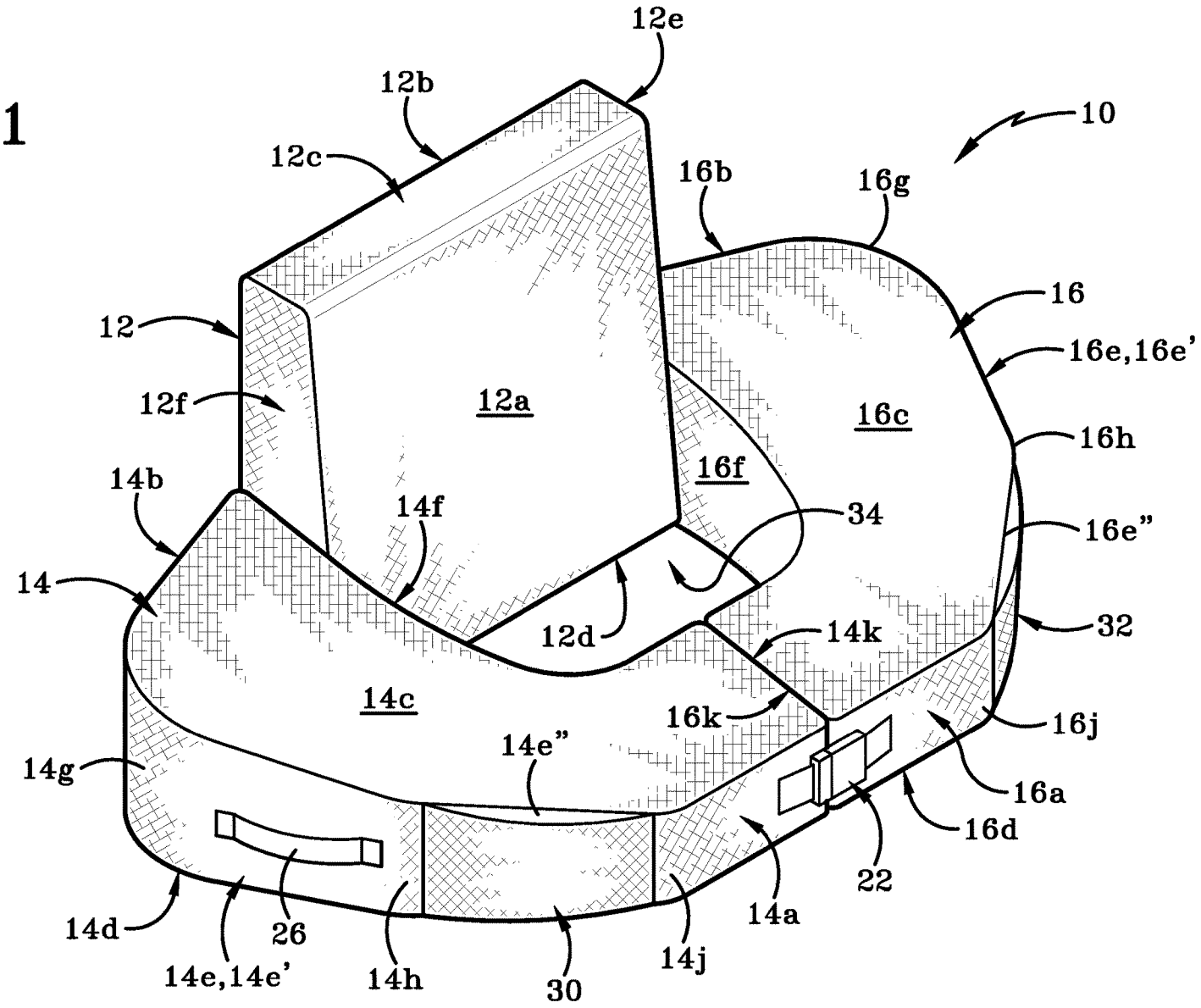
FIG. 1 is a front, top, right side perspective view of a first embodiment of a support pillow in accordance with an aspect of the present disclosure.
Figure 2:
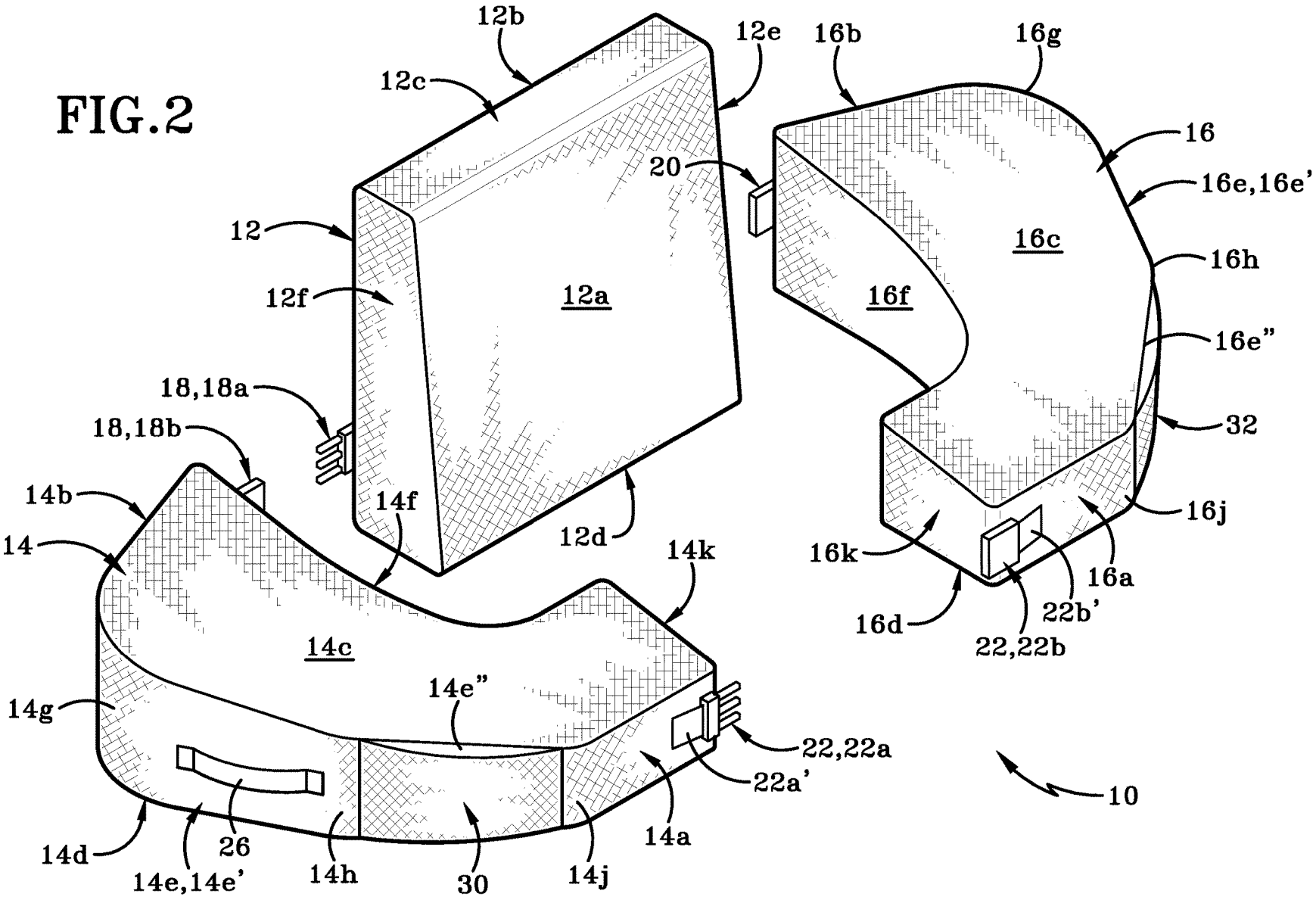
FIG. 2 is an exploded front, top, right side perspective view of the support pillow shown in FIG. 1.

Referring to FIGS. 1 and 2 there is shown a support pillow in accordance with the present disclosure, generally indicated at 10. Support pillow 10 comprises a backrest 12, a first armrest 14, and a second armrest 16. Each of the backrest 12, first armrest 14, and second armrest 16 are fabricated as separate, individual components which are able to be selectively detachably engaged with one another as will be described later herein.

Backrest 12 is a separate cushion which has a front 12*a*, a rear 12*b* (FIGS. 3 and 4), a top 12*c*, a bottom 12*d* (FIGS. 2 and 4), a left side 12*e*, and a right side 12*f*. The terms "front", "rear", "top", "bottom", "left" and "right" are used to refer to the way the support pillow 10 is illustrated in the attached drawings. These descriptive terms are also to be understood from the manner in which the support pillow 10 will be regarded from the perspective of a person seated with their back resting against the backrest 12, their right arm resting on the first armrest 14 (or right armrest), and their left arm resting on the second armrest 16 (or left armrest) of the support pillow 10.

Front 12*a* is opposed to and spaced a distance from rear 12*b* and defines a longitudinal direction therebetween. Top 12*c* is opposed to and spaced a distance from bottom 12*d* and defines a vertical direction therebetween. Left side 12*e* is opposed to and spaced a distance apart from right side 12*f* and defines a lateral direction therebetween. The left side 12*e* and right side extend between the front 12*a* and the rear 12*b*, and between the top 12*c* and bottom end 12*d*. The longitudinal direction, vertical direction, and lateral direction are arranged at 90° relative to one another.

Although not illustrated herein, it will be understood that backrest 12 is comprised of an interior foam core and an external cover (or pillowcase) which envelopes the interior core. The interior core may be made from any suitable cushioning materials which are safe for human use. In particular, the interior foam core may be made from a suitable cushioning material which is safe for use with infants. In some embodiments, the core may be comprised of foam in combination with filler materials. In one embodiment, for example, a plastic insert may be surrounded by foam material to form the interior core. The plastic insert may be used to reduce the overall costs of manufacture of the support pillow's backrest 12. (It will be understood that the first armrest 14 and second armrest 16 may be similarly fabricated.) The interior core is inserted into the external cover which preferably is selectively removable from the core for cleaning. In particular, the cover may be made from a fabric that is able to be washed in a washing machine and dried in a dryer without shrinking or fading. The cover may include any suitable closure mechanisms to retain it around the core. The closure mechanisms may include but are not limited to a zipper, snap fasteners, tie closures, and buttons. In one embodiment the interior core may be fabricated from a material that is able to be washed and dried in a similar manner to the cover. In other embodiments, the cover may be permanently engaged around the interior core and is not removable for laundering. In these other embodiments, the cover may be treated to resist stains and may further be treated to be water resistant. In yet other embodiments, the entire backrest 12, i.e., the interior core and external cover may be made from suitable materials which enable the backrest 12 as a unit to be laundered in a washer and dryer.

Figure 3:
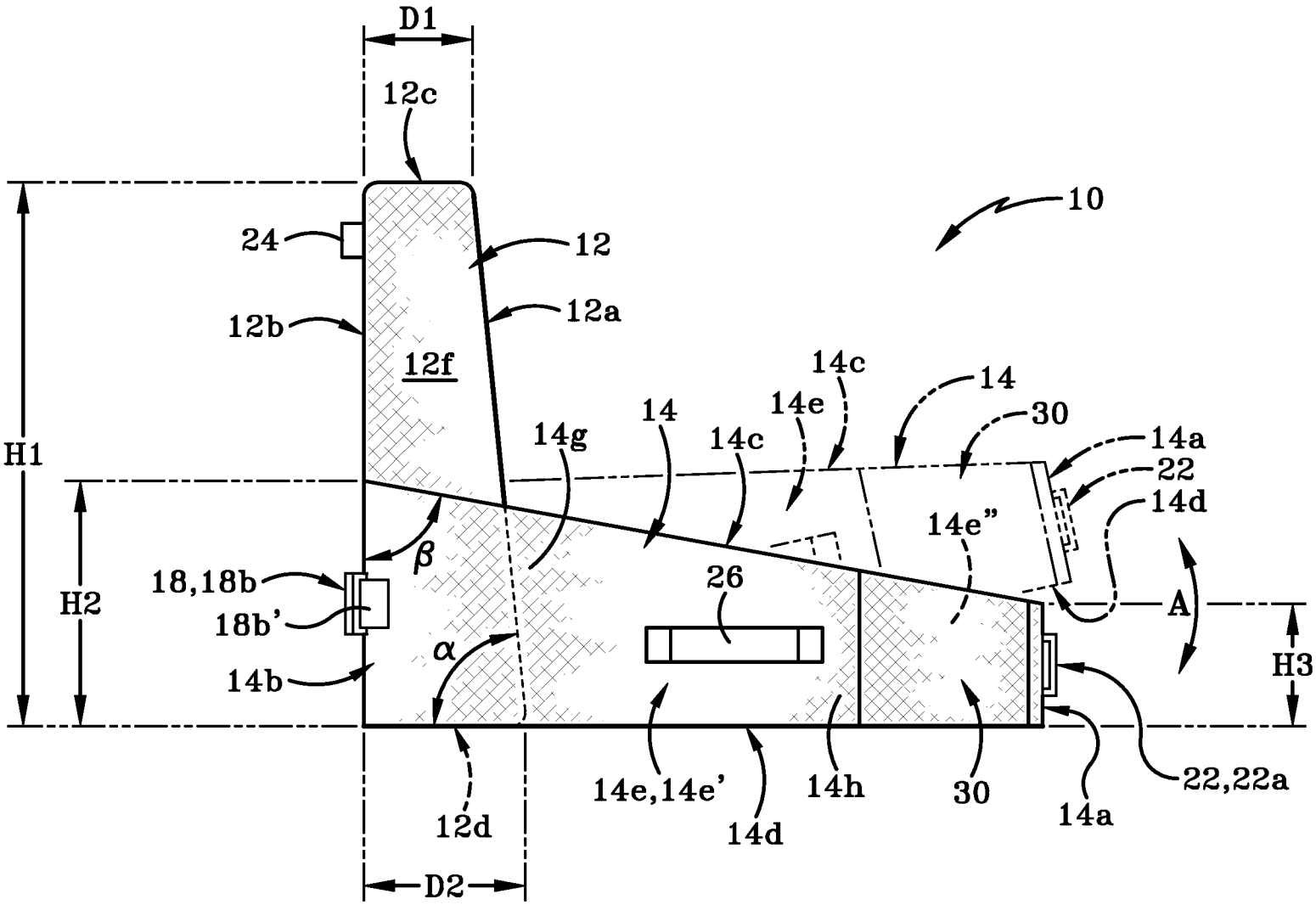
FIG. 3 is a right side elevation of the support pillow of FIG. 1.

As best seen in FIGS. 2 and 3, backrest 12 is a wedge-shaped component which is of a first depth "D1" measured between front 12*a* and rear 12*b* proximate top 12*c*. Backrest 12 is furthermore of a second depth "D2" measured between front 12*a* and rear 12*b* proximate bottom 12*d*. Depth "D2" is greater than depth "D1". As a consequence, the depth of backrest 12 tapers in a direction moving from bottom 12*d* towards top 12*c*. Rear 12*b* is oriented at 90° relative to bottom 12*d* of backrest 12. Front 12*a* of backrest 12 is oriented at an acute angle α relative to bottom 12*d*. In one embodiment, the angle α is between 75° and 85° relative to bottom 12*d*. It will be understood, however, that in other embodiments, the angle α may be smaller than 75° or slightly larger than 85° but preferably less than 90°. Because of the presence of the angle α, a person reclining against backrest 12 will have the lower portion of the backrest 12 supporting their lower back and the upper portion of the backrest 12 angling backwardly so that the person resting against the backrest will be able to relax but not fully recline or sit bolt upright. FIGS. 1 and 3 show the backrest 12 in an orientation where the wider bottom end of the wedge shape will be located so as to generally align with a person's lower back and buttocks. In this arrangement, when a person is resting against the front 12*a* of backrest 12, the angular orientation of front 12*a* will enable the seated person to remain generally upright will still being reclined against the backrest 12 at a gentle and comfortable angle.

Referring particularly to FIG. 2, it can be seen that first armrest 14 and second armrest 16 are substantially identical in configuration to one another and are arranged relative to backrest 12 as mirror images of one another.

First armrest 14 is a separate cushion which includes a front end 14*a* opposed to and spaced a distance from a rear end 14*b*. Front end 14*a* and rear end 14*b* (FIGS. 3 and 4) define a longitudinal direction therebetween. First armrest 14 further includes a top end 14*c* opposed to and spaced a distance from a bottom end 14*d* (FIG. 3). Top end 14*c* and bottom end 14*d* define a vertical direction therebetween. An outer side 14*e* is opposed to and spaced apart from an inner side 14*f*. Outer side 14*e* and inner side 14*f* define a lateral direction therebetween. Outer side 14*e* and inner side 14*f* extend between front end 14*a* and rear end 14*b*, and between top end 14*c* and bottom end 14*d*. A region of the first armrest 14 proximate the rear end 14*b* comprises a first end of the first armrest 14. A region of the first armrest 14 remote from the rear end 14*b* and proximate the front end 14*a*, particularly adjacent the inner side 14*f* comprises a second end of the first armrest 14. The second end may also be referred to herein as the "free end" of the first armrest 14. The first end of the first armrest 14 is detachably engageable with the backrest 12, as will be described later herein. The second end of the first armrest 14 is configured for detachable engagement with the second armrest 16, as will be later described herein.

Figure 4:
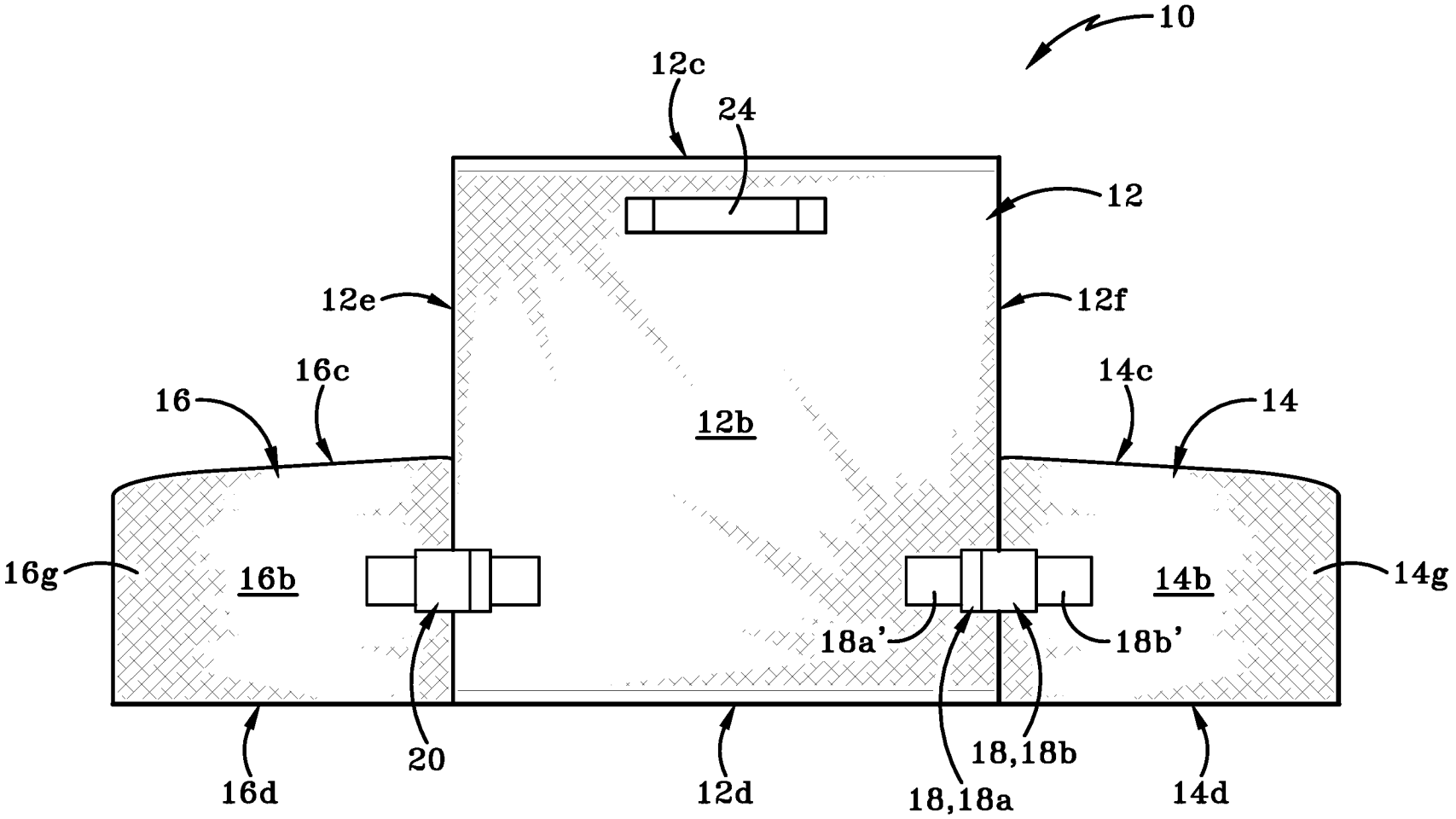
FIG. 4 is a rear elevation view of the support pillow of FIG. 1.

Similarly, second armrest 16 is a separate cushion and has a front end 16*a* opposed to and spaced a distance from a rear end 16*b* (FIG. 4). Front end 16*a* and rear end 16*b* define a longitudinal direction therebetween. Second armrest 16 further includes a top end 16*c* opposed to and spaced a distance from a bottom end 16*d* (FIG. 4). Top end 16*c* and bottom end 16*d* define a vertical direction therebetween. An outer side 16*e* of second armrest 16 is opposed to and spaced apart from an inner side 16*f* thereof. Outer side 16*e* and inner side 16*f* define a lateral direction therebetween. The outer side 16*e* and inner side 16*f* extend between front end 16*a* and rear end 16*b*, and between top end 16*c* and bottom end 16*d*. A region of second armrest 16 proximate rear end 16*b* comprises a first end of second armrest 16. A region of second armrest 16 remote from rear end 16*b* and proximate front end 16*a* thereof, particularly adjacent inner side 16*f*, comprises a second end of second armrest 16. The second end may also be referred to herein as the "free end" of second armrest 16. The first end of second armrest 16 is detachably engageable with backrest 12 in a location generally opposite where the first end of the first armrest 14 engages backrest 12. The second end of the second armrest 16 is configured for detachable engagement with first armrest 14, as will be later described herein.

Although not illustrated herein, it will be understood that first armrest 14 and second armrest 16 may be fabricated from substantially similar materials and in a similar manner to backrest 12. As such, first armrest 14 and second armrest 16 may include an interior foam core and a removable outer cover. Because the construction of first armrest 14 and second armrest 16 is substantially similar to that of backrest 12, the construction thereof will not be further discussed herein for the sake of brevity.

FIG. 3 shows that backrest 12 is of a first height "H1" measured between top 12*c* and bottom 12*d* thereof. As mentioned earlier herein, first armrest 14 and second armrest 16 are substantially identical in construction but are arranged as mirror images of one another relative to backrest 12. Each of the first armrest 14 and second armrest 16 is of a first height "H2" proximate the respective rear end 14*b*, 16*b* and is of a second height "H3" proximate the respective front end 14*a*, 16*a*. The heights "H2" and "H3" are measured between the top end 14*c*, 16*c*, and bottom end 14*d*, 16*d* of the respective one of the first armrest 14 and second armrest 16. In other words, the configuration of the armrests 14, 16 is such that they taper in height moving in a direction from rear end 14*b*, 16*b* through to front end 14*a*, 16*a* thereof. Top end 14*c*, 16*c* is oriented at an acute angle β (FIG. 3) relative to the respective rear end 14*b*, 16*b*. The acute angle is from about 75° up to about 85°. Rear end 14*b*, 16*b* is oriented at 90° relative to bottom end 14*d*, 16*d*, of the respective armrests 14, 16. Height "H1" of backrest 12 is greater than either of the first height "H2" or second height "H3" of first and second armrests 14, 16.

Armrests 14, 16 are configured to rest upon the thighs of a user. The tapered configuration of the armrests 14, 16 helps to ensure that when a user places the bottom ends 14*d*, 16*d* of the armrests 14, 16 on their thighs by lifting the armrests 14, 16 upwardly (as shown in phantom in FIG. 3), the top ends 14*c*, 16*d* of the armrests will tend to be generally horizontally oriented. When the armrests are not on the person's thighs, the top end 14*c*, 16*c* angles downwardly as shown in solid lines in FIG. 3. The tapered profile of armrests 14, 16 helps to ensure that a person's armrests are able to be rested comfortably on the top end 14*c*, 16*c* in a natural position. If the armrests 14, 16 were of a constant height from front to back then a person's armrests could be held at a less natural and therefore more uncomfortable position. If the pillow 10 were being used by a parent or caregiver to support an infant thereon, the armrests 14, 16 resting on the parent's thighs will tend to gently roll the infant towards the body of the parent or caregiver at a natural height instead of lifting the infant too high and causing a sharp roll of the child towards the caregiver's body. The possible raising and lowering of the front ends of the armrests 14, 16 is indicated by arrow "A" in FIG. 3.

Figure 5:
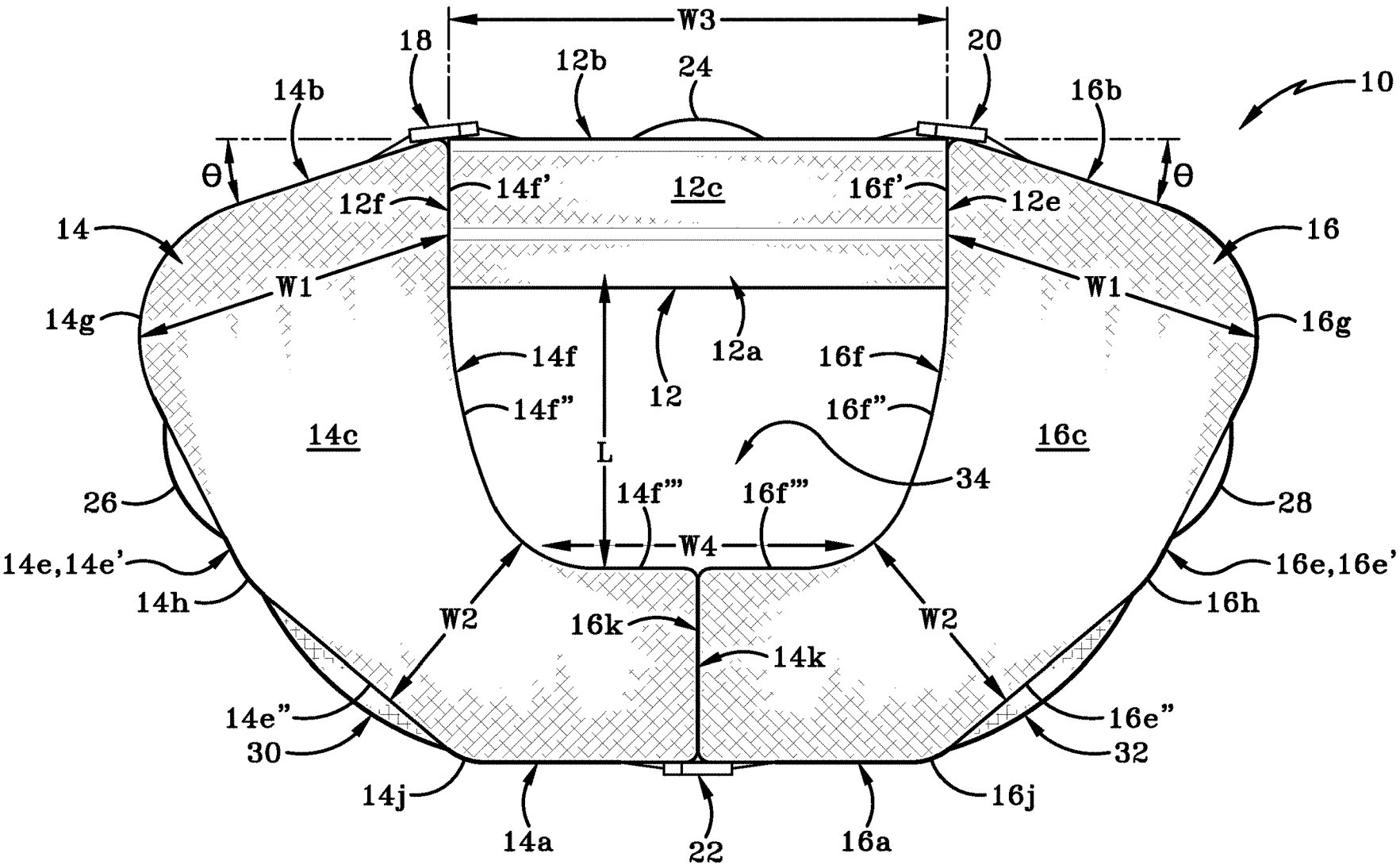
FIG. 5 is a top plan view of the support pillow of FIG. 1.

FIG. 5 shows that rear 12*b* of backrest 12 is substantially straight or planar from left side 12*e* to right side 12*f*. When pillow 10 is assembled, as shown in FIGS. 1 and 5, the rear end 14*b* of first armrest 14 angles outwardly and forwardly at an angle Θ relative to the rear 12*b* of backrest 12. Similarly, the rear end 16*b* of second armrest 16 angles outwardly and forwardly at the same angle Θ relative to the rear 12*b* of backrest 12. In one embodiment, the angle Θ is from about 190° up to about 210°. FIG. 5 shows the angle Θ at 200° relative to rear 12*b* of backrest 12.

FIGS. 2 and 5 show that each of the first armrest 14 and second armrest 16 is generally J-shaped in configuration and includes a first leg and a second leg that are oriented generally at a right angle to one another. Because first and second armrests 14, 16 are arranged as mirror images of one another in pillow 10, when the assembled pillow 10 is viewed from above, as in FIG. 5, the first armrest 14 is of an inverted J-shape and the second armrest 16 is J-shaped.

Referring still to FIG. 5, the first leg of each armrest 14, 16 extends forwardly and inwardly from an outermost end of the respective rear section 14*c*, 16*c*. The outermost end of rear section 14*c*, 16*c* is that region which is remote from backrest 12. The second leg of each armrest 14, 16 extends outwardly from the first leg thereof and is oriented generally parallel to front 12*a* of backrest 12. The outer side 14*e*, 16*e* joins the outermost end of the respective rear end 14*b*, 16*b* at a curved first corner 14*g*. Each outer side 14*e*, 16*e* is comprised of a first section 14*e*', 16*e*' and a second section 14*e*", 16*e*" which meet at a curved second corner 14*h*, 16*h*. The first section 14*e*' 16*e*' extends forwardly and inwardly from the curved first corner 14*g*, 16*g* and the second section 14*e*", 16*e*" extends further forwardly and inwardly from curved second corner 14*h*, 16*h*, respectively. Each of the first section 14*e*', 16*e*' and second section 14*e*", 16" is generally straight along its length. Second section 14*e*", 16*e*" joins front end 14*a*, 16*a*, respectively at a curved third corner 14*j*, 16*j*. The inner side 14*f*, 16*f* is of an inverted J-shape (for first armrest 14) and a J-shape (for second armrest 16.)

Because of the configuration of outer side 14*e*, 16*e* relative to inner side 14*f*, 16*f*, the first leg of each of the first armrest 14 and second armrest 16 is of a greater first width "W1" proximate rear end 14*b*, 16*b* and narrows in width moving forwardly towards front end 14*a*, 16*a*. Where second leg extends outwardly from first leg, the width of the first leg is indicated as the second width "W2". The width "W2" is less than the width "W1". The inverted J-shape of first armrest 14 is further formed by providing an end face 14*k* which extends between inner side 14*f* and front end 14*a*. Similarly, the J-shaped of second armrest 16 is further formed by providing an end face 16*k* which extends between inner side 16*f* and front end 16*a*. End face 14*k* is oriented at a right angle relative to front end 14*a*. Similarly, end face 16*k* is oriented at a right angle relative to front end 16*a*. End face 14*k* and end face 16*k* are opposed to one another and are configured to abut one another. The location where end faces 14*k*, 16*k* meet is located a distance longitudinally forward of front 12*a* of backrest.

Referring to FIG. 5, inner side 14*f* of first armrest 14 includes a first section 14*f*', a second section 14*f*", and a third section 14*f*"'. First section 14*f*' is substantially straight and is configured to extend along second side 12*f* of backrest 12 and to remain in close abutting contact therewith. Second section 14*f*" is an elongate arcuate region of first armrest 14 which extends forwardly from first section 14*f*'. Third section 14*f*"' extends inwardly from second section 14*f*" and is substantially straight. Third section 14*f*"' intersects with end face 14*k* in such a way that third section 14*f*"' and end 14*k* are oriented at 90° to one another. Similarly, inner side 16*f* of second armrest 16 includes a first section 16*f*', a second section 16*f*", and a third section 16*f*"'. First section 16*f*' is substantially straight and is configured to extend along first side 12*e* of backrest 12 and to remain in close abutting contact therewith. Second section 16*f*" is an elongate arcuate region of second armrest 16 which extends forwardly from first section 16*f*'. Third section 16*f*"' extends inwardly from second section 16*f*" and is substantially straight. Third section 16*f*"' intersects with end face 16*k* in such a way that third section 16*f*"' and end 16*k* are oriented at 90° to one another.

Referring still to FIG. 5, first section 14*f*' of first armrest 14 and first section 16*f*' of second armrest 16 are spaced laterally from one another. The lateral distance between first section 14*f*' and first section 16*f*' is substantially equal to the width "W3" of backrest 12. Second sections 14*f*" and 16*f*" gradually curve inwardly towards one another moving in a direction outwardly away from front 12*a* of backrest 12. The space 34 encircled by front 12*a* of backrest 12 and first and second armrests 14, 16 narrows to a width "W4" proximate third sections 14*f*"' and 16*f*"' of the two armrests 14, 16. Space 34 is of a length "L" measured between front 12*a* of backrest 12 and third sections 14*f*"' and 16*f*"'. The straight third sections 14*f*"' and 16*f*"' are oriented substantially parallel to front 12*a* of backrest 12 and are substantially laterally aligned with one another.

The torso of a person using support pillow 10 is received within space 34. It will be understood that the inner side 14*f*, 16*f* of the first leg of each of the first armrest 14 and second armrest is configured to extend comfortably along the sides of the person's torso when they are seated with their back resting on backrest 12. In this position, the second legs of each of the first armrest 14 and second armrest 16 curve in front of the person's abdomen. The end faces 14*k*, 16*k* face one another and abut one another.

Referring now to FIGS. 4 and 2, a first securement mechanism 18 is provided to secure first armrest 14 to backrest 12 and a second securement mechanism 20 is provided to secure second armrest 16 to backrest 12. Any suitable type of securement mechanism can be used for this purpose. The attached figures, however, show a quick release buckle assembly being used as first securement mechanism 18 and second securement mechanism 20. The first securement mechanism 18 includes a buckle 18*a* secured via a strap 18*a*' to rear 12*b* of backrest 12. First securement mechanism 18 further includes a housing 18*b* secured via a strap 18*b*' to rear end 14*b* of first armrest 14. The buckle 18*a* may, instead, be secured to first armrest 14 and the housing 18*b* may be secured to backrest 12. Second securement mechanism 20 is of a substantially identical configuration to first securement mechanism 18 and therefore won't be described in further detail. Quick release buckle assemblies and their operation are well known and therefore won't be described in any further detail herein.

First armrest 14 and second armrest 16 are individually detachably secured to backrest 12 via the first securement mechanism 18 and second securement mechanism 20. If only one armrest is desired to be engaged with backrest 12, then only that desired armrest will be secured to backrest 12. If both armrests 14, 16 are desired to be engaged with backrest 12, then both armrests will be secured thereto by the appropriate first and second securement mechanisms 18, 20. If armrests 14, 16 are engaged with backrest 12 and the user wishes to detach both armrests 14, 16, the user simply has to disengage both buckles (such as buckle 18*a*) from their associated housing 18*b*.

Although not illustrated herein, it will be understood that, provided the first and second securement mechanisms 18, 20 are arranged on backrest 12 as mirror images of one another, it is possible to engage second armrest 16 with backrest 12 in the location occupied by first armrest 14, i.e., proximate right side 12*f* instead of proximate left side 12*e*. In this instance the armrests 14, 16 would not encircle a user's torso but would instead angle outwardly away from the user's legs. This particular arrangement of the armrests 14, 16 relative to the backrest 12 would be selected if the user desired to use the pillow in a different manner.

FIG. 1 shows that a third securement mechanism 22 is provided to selectively and adjustably secure first armrest 14 and second armrest 16 to one another. The third securement mechanism 22 is also illustrated as being a quick release buckle assembly identical to first securement mechanism 18. Third securement mechanism 22 includes a buckle 22*a* secured to front end 14*a* of first armrest 14 via a strap 22*a*' and a housing 22*b* secured to front end 16*a* of second armrest 16 via a strap 22*b*'. (The buckle 22*a* could, instead, be secured to the second armrest 16 and the housing 22*b* could be secured to the first armrest 14. The third securement mechanism 22 is within easy reach of a person sitting with their back against the backrest 12. If it is desired to secured first armrest 14 to second armrest 16 such that the two end faces 14*k*, 16*k* do not move away from one another during use, then third securement mechanism 22 will be utilized to secure the armrests to one another. If the person no longer wishes the two armrests 14, 16 to be locked in place around their torso, they will simply disengage the buckle 22*a* from housing 22*b*.

It will be understood that other types of securement mechanism can be utilized on pillow 10 in place of one or more of the quick release buckle assemblies 18, 20, 22 shown in the attached figures. For example, the quick release buckle assemblies 18, 20, 22 could be replaced with hook and loop fastener strips or with straps that include snaps or buttons and button holes.

Support pillow 10 includes a handle on each of backrest 12, first armrest 14, and second armrest 16. Handle 24 (FIG. 4) is provided on rear 12*b* of backrest 12; handle 26 is provided on first armrest 14; and handle 28 (FIG. 5) is provided on second armrest 16. The handle 24 may be placed at any location on support pillow 10 such as, but not limited to, an upper portion of the rear 12*b* thereof. Similarly, the handle 26 may be placed at any location on first armrest 14 such as, but not limited to, the first section 14*e*' of outer side 14*e*. Similarly, the handle 28 may be placed at any location on second armrest 16 such as, but not limited to, the first section 16*e*' of outer side 16*e*. Handles 24, 26, 28 are provided to enable a user to carry the entire support pillow 10 or one of the parts thereof, i.e., the backrest 12, first armrest 14, or second armrest 16.

One or more pockets are provided on support pillow 10. The attached figures show a pocket 30 provided on first armrest 14 and a pocket 32 provided on second armrest 16. Pocket 30 is illustrated as being located on second section 14*e*" of outer side 14*e* of first armrest 14. Similarly, pocket 32 is illustrated as being located on second section 16*e*" of outer side 16*e* of second armrest 16. It will be understood, however, that pockets 30, 32 may be of any desired configuration and at any desired location on the associated armrest 14, 16. Pockets 30, 32 are suitably shaped and sized to receive objects such as a cellphone, tablet, books, eyeglasses, baby bottles etc. Pockets 30, 32 may be fabricated from the same material as the associated first armrest 14 or second armrest 16, or may be fabricated from a different material, such as a mesh fabric. It will further be understood that one or more pockets may additionally or alternatively be provided on backrest 12. For example, a pocket may be provided on rear 12*b* of backrest 12 or on either of the left side 12*e* or right side 12*f*.

Referring now to FIGS. 1 through 6B, the assembly and use of support pillow 10 will be described. In a first assembly step, the first armrest 14 is engaged with the backrest 12 by securing the first securement mechanism 18. Similarly, the second armrest 16 is engaged with the backrest 14 by securing the second securement mechanism 20. When support pillow 10 is fully assembled, as illustrated in FIG. 1, then backrest 12, first armrest 14, and second armrest 16 together bound and define a space 34.

Figure 6A:
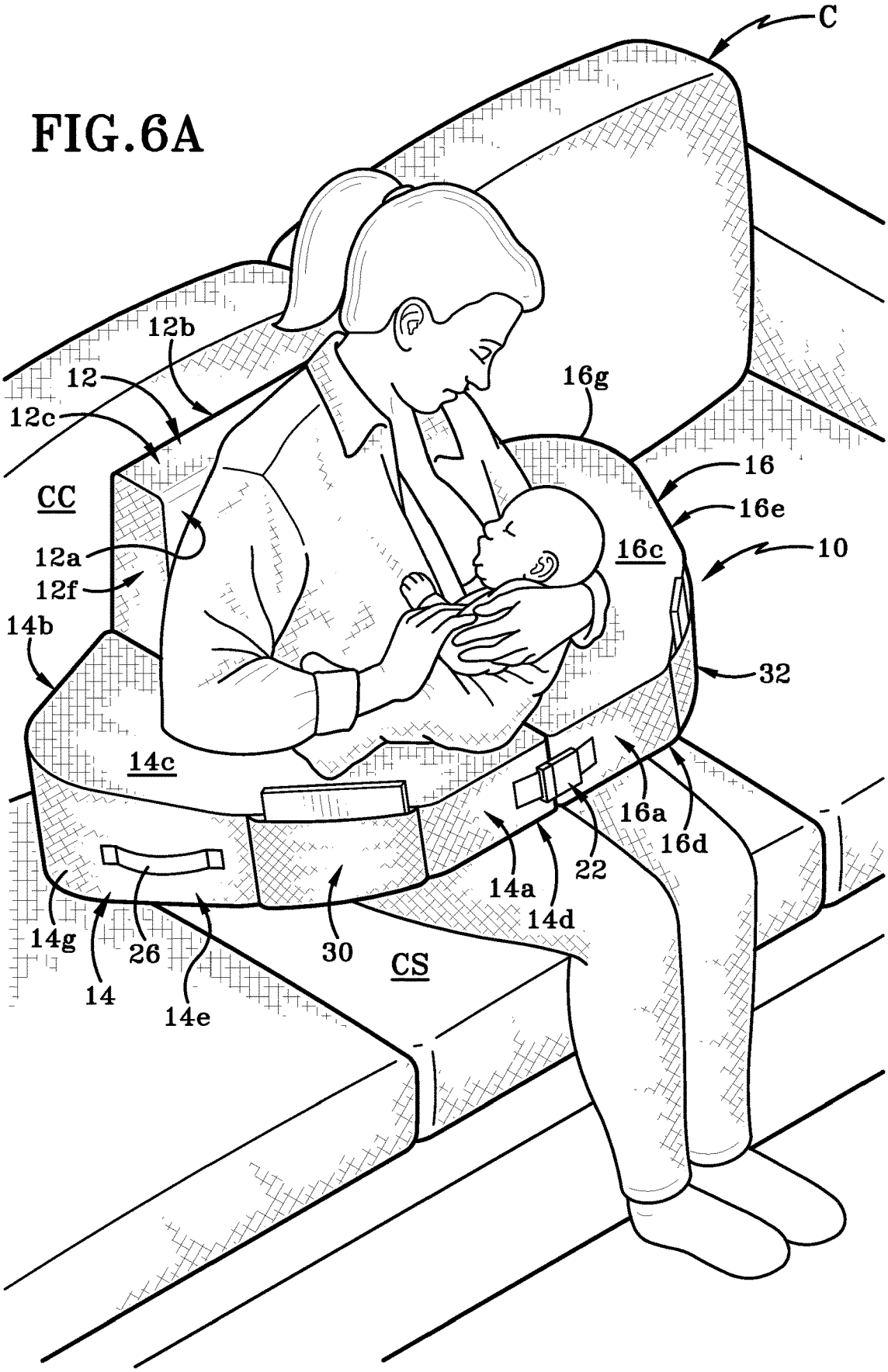
FIG. 6A is a front, top, right side perspective view of a first operational view of the support pillow in accordance with the present disclosure being used to support the body of a mother while nursing their infant.

The support pillow 10 is then placed on a surface upon which a user will be seated while using support pillow 10. FIG. 6A shows a first operational position of support pillow 10. The figure shows the support pillow 10 placed on a couch "C" in such a way that the rear 12*b* of backrest 12 abuts a front surface of a couch cushion "CC". The bottom 12*d* of backrest 12 rests on the couch seat "CS". A mother of an infant is shown seated on the couch seat "CS" with her back resting against the front 12*a* of backrest 12. The first armrest 14 and second armrest 16 are engaged with backrest 12 and have been lifted up to rest upon the mother's thighs. The third securement 22 has been used to secure first armrest 14 and second armrest 16 to one another. This arrangement makes it comfortable for the mother to rest her right arm on the top end 14*c* of the first armrest 14 and to rest her left arm on the top end 16*c* of the second armrest 16. It should be noted that the mother's body is located within the space 34 (FIG. 1) defined by backrest 12, first armrest 14, and second armrest 16. The backrest 12, first armrest 14, and second armrest 16 encircle the mother's torso. The abutting end faces 14*k*, 16*k* of the two armrests 14, 16 are located in front of the mother's abdomen. An infant is illustrated as being held in the mother's left arm with infant's body resting comfortably on the top ends 14*c*, 16*c* of the first and second armrests 14, 16. Obviously, the mother can readily reposition the infant so that they are cradled in their mother's right arm and with their body being comfortably supported on the top ends 16*c*, 14*c* of the armrests 14, 16. The first armrest 14 and second armrest 16 are arranged so that the top ends 14*c*, 16*c*, respectively, are relatively flat. The configuration helps to ensure that there is less likelihood of the infant accidentally rolling off the first armrest 14 and second armrest 16. The configuration of the armrests 14, 16 also helps to distribute the weight of the baby relatively easily over the mother's lap.

Obviously, instead of being used while breastfeeding, support pillow 10 provides a comfortable setting for nursing a baby with a bottle or simply cradling an infant or young child. Support pillow 10 is also useful for providing a comfortable setting for a mother to pump breast milk. Support pillow 10 not only provides a comfortable position for the mother's armrests to rest but the relatively flat top ends 14*c*, 16*c* of first armrest 14 and second armrest 16 provide a sufficiently stable enough platform upon which to rest the equipment needed while pumping breast milk.

It is quite easy for the mother to disengage the third securement mechanism 22 between the first armrest 14 and second armrest 16 with one hand when she needs to get up from the couch "C" but still has the infant in their arms. The third securement mechanism 22 may be disengaged simply by depressing the appropriate parts of the buckle 22*a*. Disengaging the third securement mechanism 22 allows the free ends of the armrests to move apart from one another and the mother can stand up relatively unimpeded by the armrests 14, 16.

Figure 6B:
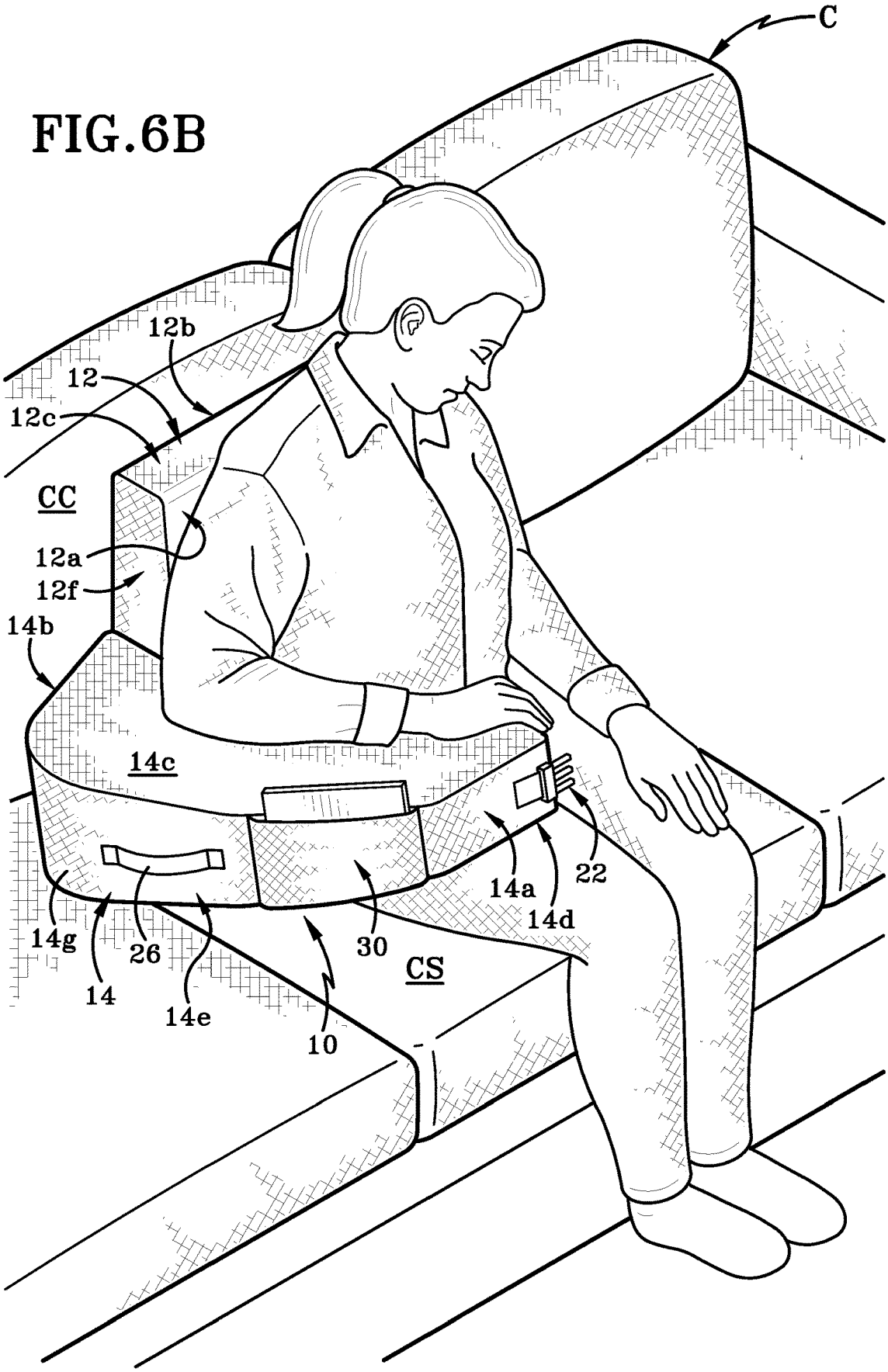
FIG. 6B is a front, top, right side perspective view of a second operational view of the support pillow in use and showing one of the armrests disengaged from the backrest and a person comfortably seated and supported thereby.

FIG. 6B illustrates a situation where the second armrest 16 has been detached from backrest 12 (by disengaging the second securement mechanism 20). The first armrest 18 remains engaged with backrest 12 and a person is shown seated on the couch seat "CS" with her back abutting front 12*a* of backrest 12 and her right arm resting comfortably on first armrest 14.

Each of the backrest 12, first armrest 14 and second armrest 16 may be detached from support pillow 10 and be used on their own. It will be understood that because the first armrest 14 and second armrest 16 are identical to one another, either arm can be engaged on either side of the backrest 12; the arm in question simply needs to be flipped over to assume the correct orientation for engagement with the backrest 12. Pockets can be provided accordingly on first and second armrests 14, 16 so that some pockets open towards top end 14*c*, 16*c* and others open towards bottom end 14*d*, 16*d*.

It will be understood that support pillow 10 may be used in other settings such as in a bed (for a person recovering from illness or surgery) or even on a floor surface where there is no support for the backrest 12. Support pillow 12 can also be used in settings, such as on a floor or carpet, where the backrest 12 will then provide sufficient support for the user to be seated comfortably while feeding a baby, for example.

It will be understood that in other embodiments not illustrated herein, the first armrest and second armrest may be permanently secured to the backrest to form a single, unitary component. The free ends of the first armrest and second armrest may still be detachably securable to one another to encircle the torso of the user. The resultant support pillow will be used in an identical manner to support pillow 10 as described earlier herein except with respect to adjustability functions that are not possible because of the configuration of the component parts of this alternative embodiment.

In yet other embodiments not illustrated herein, only one of the two armrests may be integrally connected with the backrest to form a single unitary component. The other of the two armrests may be detachably engageable with the backrest. The permanently attached armrest and the detachable armrest will still be able to be selectively engaged with one another via a securement mechanism to hold the two end faces of the armrests in abutting contact with one another. The resultant support pillow will be used in an identical manner as described earlier herein except with respect to adjustability functions that are not possible because of the configuration of the component parts of this alternative embodiment.

In summary, a method is disclosed which includes providing a support pillow 10 having a backrest 12 with a front 12*a*, a rear 12*b*, a top 12*c*, a bottom 12*d*, and left and right sides 12*e*, 12*f* extending from the front 12*a* to the back 12*b*, and from the top 12*c* to the bottom 12*d*. The method further includes engaging a first end of a first armrest 14 with the backrest 12 via a first securement mechanism 18 and engaging a first end of a second armrest 16 with the backrest 12 via a second securement mechanism 20. The first end of the first armrest 14 is located on the backrest 12 generally laterally opposite the first end of the second armrest 16. In other words, first armrest 14 is laterally-spaced from second armrest 16. The method includes placing a second end (i.e., proximate the front end 14*a* and inner side 14*f*) of the first armrest 14 in close proximity to a second end (i.e., proximate front end 16*a* and inner side 16*f*) of the second armrest 16. The second end of the first armrest 14 and the second end of the second armrest 16 are spaced a distance forwardly away from the backrest 12. A person's back is placed in abutting contact with the front 12*a* of the backrest 12 such that their torso is located in the space 34 defined by support pillow 10. The person's torso is encircled by backrest 12, first armrest 14, and second armrest 16. The second end or free end of the first armrest 14 and the second end or free end of the second armrest 16 are located in front of a central region of the person's abdomen.

The method may further comprise detachably engaging one or both of the first end of the first armrest 14 and the first end of the second armrest 16 to the backrest. The method may include detachably securing the second end of the first armrest 14 to the second end of the second armrest 16 via the third securement mechanism 22.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90° or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention.

The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A support pillow comprising:

a backrest;

a first armrest engageable with the backrest;

a second armrest engageable with the backrest a lateral distance away from the first armrest;

wherein each of the first armrest and the second armrest extends forwardly from the backrest and curves inwardly to terminate in a free end located a distance forwardly of a front of the backrest;

wherein the free end of the first armrest is opposed to the free end of the second armrest;

wherein the backrest, the first armrest, and the second armrest, together, encircle a space adapted to receive a torso of a person therein;

a securement mechanism which detachably secures the free end of the first armrest to the free end of the second armrest;

wherein one or both of the first armrest and the second armrest is detachably engageable with the backrest;

wherein the first armrest and the second armrest are substantially identical to one another and are arranged as mirror images of one another relative to the backrest; and wherein each of the first armrest and the second armrest has: a top end, a bottom end, a front end, and a rear end; wherein each of the first armrest and the second armrest is of a height measured between the top end and the bottom end thereof; and wherein the height tapers moving in a direction from the rear end of the first armrest and the second armrest to the front end thereof.

2. The support pillow according to claim 1, further comprising a first securement mechanism for detachably securing one of the first armrest and the second armrest to the backrest.

3. The support pillow according to claim 2, further comprising a second securement mechanism for detachably securing the other of the first armrest and the second armrest to the backrest.

4. The support pillow according to claim 1, wherein the backrest has a depth measured between the front and a rear thereof, and wherein the depth tapers moving in a direction from a bottom of the backrest to a top of the backrest.

5. The support pillow according to claim 1, wherein the front of the backrest is oriented at an angle of from about 75° up to about 85° relative to a bottom of the backrest.

6. The support pillow according to claim 5, wherein a rear of the backrest is oriented at 90° relative to a bottom of the backrest.

7. The support pillow according to claim 1, further comprising a handle provided on the backrest.

8. The support pillow according to claim 1, wherein the top end of each of the first armrest and the second armrest is oriented at an angle of from about 75° up to about 85° relative to the rear end thereof.

9. The support pillow according to claim 8, wherein the rear end of the first armrest and the second armrest is oriented at 90° relative to the bottom end thereof.

10. The support pillow according to claim 1, further comprising a handle provided on one or both of the first armrest and the second armrest.

11. The support pillow according to claim 1, wherein a rear end of each of the first armrest and the second armrest is oriented at an angle of from about 190° up to about 210° relative to a back of the backrest.

12. The support pillow according to claim 1, wherein each of the first armrest and the second armrest is generally J-shaped.

13. The support pillow according to claim 1, wherein each of the first armrest and the second armrest is of a width proximate a rear end thereof, wherein the rear end is located proximate a back of the backrest, and wherein the width tapers moving from the rear end towards a front end thereof.

14. The support pillow according to claim 1, further comprising one or more pockets provided on one or more of the backrest, the first armrest, and the second armrest.

15. A method comprising:

detachably engaging a first end of a first armrest with a backrest of a support pillow;

detachably engaging a first end of a second armrest with the backrest a laterally-spaced distance from the first end of the first armrest;

arranging the first armrest and the second armrest as mirror images of one another relative to the backseat;

wherein the first armrest and the second armrest are substantially identical to one another and each the first armrest and the second armrest has: a top end, a bottom end, a front end, and a rear end; wherein each of the first armrest and the second armrest is of a height measured between the top end and the bottom end thereof; and wherein the height tapers moving in a direction from the rear end of the first armrest and the second armrest to the front end thereof;

placing a second end of the first armrest in close proximity to a second end of the second armrest a distance longitudinally forwardly of a front of the backrest;

encircling a space with the backrest, the first armrest, and the second armrest; wherein the space is adapted to receive a torso of a person resting against the backrest; and detachable securing the second end of the first armrest to the second end of the second armrest with a securement mechanism.

* * * * *